US007819277B2

(12) United States Patent
Hanson

(10) Patent No.: US 7,819,277 B2
(45) Date of Patent: Oct. 26, 2010

(54) SINGLE-SHEETED-TYPE AND DUAL-HANDLED-TYPE CARRIER FOR SUSPENDING A DRINKING CUP BY ONE HAND AND METHOD

(76) Inventor: Violet Hanson, P.O. Box 68, Old Bethpage, NY (US) 11804

( * ) Notice: Subject to any disclaimer, the term of this patent is extended or adjusted under 35 U.S.C. 154(b) by 0 days.

(21) Appl. No.: 12/151,673

(22) Filed: May 8, 2008

(65) Prior Publication Data

US 2009/0277935 A1 Nov. 12, 2009

(51) Int. Cl.
*B65D 90/12* (2006.01)
*B65D 25/00* (2006.01)

(52) U.S. Cl. ..... 220/737; 220/62

(58) Field of Classification Search ..... 206/218; 215/395; 229/402, 117.13, 117.12, 117.09; 220/772, DIG. 30, 738, 739, 752, 903; 294/157, 294/152, 149, 137; 383/7, 14, 18, 22; D9/455, D9/434; D7/602, 601; 224/148.4, 148.1
See application file for complete search history.

(56) References Cited

U.S. PATENT DOCUMENTS

| | | | | | |
|---|---|---|---|---|---|
| 1,732,322 | A | | 10/1929 | Wilson et al. | |
| 1,771,765 | A | | 7/1930 | Benson | |
| 1,910,168 | A | * | 5/1933 | Jacobs | 294/142 |
| 1,982,276 | A | * | 11/1934 | West | 294/27.1 |
| 2,047,095 | A | * | 7/1936 | Booth | 383/18 |
| 2,069,997 | A | * | 2/1937 | Carr | 206/169 |
| 2,266,828 | A | | 12/1941 | Sykes | 229/14 |
| 2,300,473 | A | | 11/1942 | Winkle | 229/4.5 |
| 2,501,815 | A | | 3/1950 | Hamm | 16/1.16 |
| 2,581,100 | A | * | 1/1952 | Hennessy | 446/80 |
| 2,617,549 | A | | 11/1952 | Egger | 215/100 |
| 2,641,402 | A | | 6/1953 | Bruun | 229/4.5 |
| 2,661,889 | A | | 12/1953 | Phinney | 229/14 |
| 2,676,731 | A | * | 4/1954 | Klein | 206/183 |
| 2,723,488 | A | * | 11/1955 | Ringler | 446/79 |
| 2,850,205 | A | * | 9/1958 | Painter | 206/182 |
| 2,936,068 | A | * | 5/1960 | Munkachy | 220/737 |
| 2,969,901 | A | | 1/1961 | Behrens | 229/1.5 |
| 3,142,435 | A | * | 7/1964 | Stange et al. | 383/37 |
| 3,237,834 | A | | 3/1966 | Davis et al. | 229/1.5 |
| 3,565,323 | A | * | 2/1971 | Katzenmeyer | 229/117.14 |
| 3,779,157 | A | | 12/1973 | Ross, Jr. et al. | 100/240 |
| 3,785,254 | A | | 1/1974 | Mann | 93/36.01 |
| 3,890,762 | A | | 6/1975 | Ernst et al. | 53/25 |
| 3,908,523 | A | | 9/1975 | Shikaya | 93/36.01 |
| 4,049,116 | A | * | 9/1977 | Cope | 206/176 |
| 4,080,880 | A | | 3/1978 | Shikaya | 93/94 |
| 4,084,688 | A | * | 4/1978 | Hughes | 206/188 |
| 4,146,660 | A | | 3/1979 | Hall et al. | 428/2 |
| 4,176,054 | A | | 11/1979 | Kelley | 209/8 |

(Continued)

FOREIGN PATENT DOCUMENTS

JP 06156474 A * 6/1994

*Primary Examiner*—Anthony Stashick
*Assistant Examiner*—Robert J Hicks
(74) *Attorney, Agent, or Firm*—Bernard S. Hoffman

(57) ABSTRACT

A single-sheeted-type and dual-handled-type carrier for suspending a drinking cup by one hand and method. The carrier includes a single sheet blank. The single sheet blank is rectangular-shaped, planar, and cut and folded into a specific configuration having dual handles for suspending the drinking cup from the one hand.

9 Claims, 6 Drawing Sheets

U.S. PATENT DOCUMENTS

| | | | | | |
|---|---|---|---|---|---|
| 4,923,082 | A | * | 5/1990 | Bird | 220/737 |
| 5,009,326 | A | | 4/1991 | Reaves et al. | 220/441 |
| 5,092,485 | A | | 3/1992 | Lee | 220/441 |
| 5,205,473 | A | | 4/1993 | Coffin, Sr. | 229/1.5 B |
| 5,222,656 | A | | 6/1993 | Carlson | 229/1.5 H |
| 5,348,156 | A | * | 9/1994 | Maroszek et al. | 206/216 |
| 5,385,260 | A | | 1/1995 | Gatcomb | 220/415 |
| 5,584,430 | A | * | 12/1996 | Mulry | 229/117.16 |
| 5,826,786 | A | | 10/1998 | Dickert | 229/403 |
| D401,122 | S | | 11/1998 | Rench et al. | D7/624 |
| 5,927,502 | A | * | 7/1999 | Hunter | 206/549 |
| 6,152,363 | A | | 11/2000 | Rule, Jr. | 229/403 |
| 6,158,612 | A | | 12/2000 | Alpert | 220/739 |
| 6,277,454 | B1 | | 8/2001 | Neale et al. | 428/34.2 |
| D493,108 | S | | 7/2004 | Burr et al. | D9/433 |
| 6,834,762 | B2 | * | 12/2004 | Krisko et al. | 206/162 |
| D524,118 | S | | 7/2006 | Gregorczyk | D7/624.2 |
| D543,844 | S | | 6/2007 | Cook et al. | D9/444 |
| 2001/0021282 | A1 | * | 9/2001 | Hanson | 383/120 |
| 2003/0071045 | A1 | * | 4/2003 | Taylor | 220/737 |
| 2003/0106828 | A1 | * | 6/2003 | Hunter | 206/549 |
| 2006/0138155 | A1 | * | 6/2006 | Kratz | 220/737 |

* cited by examiner

SINGLE-SHEETED-TYPE AND DUAL-HANDLED-TYPE CARRIER FOR SUSPENDING A DRINKING CUP BY ONE HAND AND METHOD

1. BACKGROUND OF THE INVENTION

A. Field of the Invention

The embodiments of the present invention relate to a carrier for a drinking cup, and more particularly, the embodiments of the present invention relate to a single-sheeted-type and dual-handled-type carrier for suspending a drinking cup by one hand and method.

B. Description of the Prior Art

A beverage sold at fast food outlets is usually served in a disposable plastic or wax-coated, paper cup. A cup-holder is provided if the beverage is to be consumed off the premises. The cup-holder allows a cup to be carried by one person. A cup-holder is usually composed of molded paper pulp or plastic having an opening for the cup.

Numerous innovations for containers, cups, and related devices have been provided in the prior art that will be described below in chronological order to show advancement in the art, and which is incorporated herein by reference thereto. Even though these innovations may be suitable for the specific individual purposes to which they address, however, they differ from the present invention in that they do not teach a single-sheeted-type and dual-handled-type carrier for suspending a drinking cup by one hand and method.

(1) U.S. Pat. No. 1,732,322 to Wilson et al.

U.S. Pat. No. 1,732,322 issued to Wilson et al. on Oct. 22, 1929 teaches a machine for making edible cups, which includes a sectional mold and a base upon which the mold is supported and has a standard. The standard supports a screw-threaded bearing. A screw-threaded plunger rod passes through the bearing and has apparatus, whereby it may be rotated. A plunger is carried upon the lower end of the rod, rotates therewith, and engages in the mold. Apparatus raises or lowers the bearing supporting the plunger rod.

(2) U.S. Pat. No. 1,771,765 to Benson.

U.S. Pat. No. 1,771,765 issued to Benson on Jul. 29, 1930 teaches an insulating vessel including a walled container having an upraised bottom and an insulating sleeve with integral corrugations frictionally engaging with the walled container. The sleeve extends underneath the raised bottom of the container.

(3) U.S. Pat. No. 2,266,828 to Sykes.

U.S. Pat. No. 2,266,828 issued to Sykes on Dec. 23, 1941 in class 229 and subclass 14 teaches a paper cup including a substantially cylindrical paper body adapted to be held in the hand, provided at its top with a circumferential reenforcing bead, and provided at its bottom with an inwardly and upwardly turned flange. A bottom closure member sits on the flange and is provided with an upwardly extending circumferential flange sitting against, and secured to, the surrounding wall of the body. A substantially cylindrical paper liner is within the body and has its bottom portion straight fitted within, and secured to, the flange of the bottom closure member. The liner has an outwardly extending circumferential bead at its top, which fits over, and is secured to, the head at the top of the body. The liner is provided between its top and its bottom portions with circumferential reenforcing corrugations.

(4) U.S. Pat. No. 2,300,473 to Winkle.

U.S. Pat. No. 2,300,473 issued to Winkle on Nov. 3, 1942 in class 229 and subclass 4.5 teaches an ornamental container arrangement including a sheet of corrugated paper board suitably joined end-to-end for tubular formation and content envelopment. The board has at least a liner layer interiorly of a corrugated layer. The corrugated layer is slit transversely to the axis of the tubular formation. The slit-defined end portion of the layer and the liner portion secured thereto is turned inwardly at the slit portion. The liner layer, at the slit, constitutes the hinge connection only. The inturned portion of the corrugated layer forms a retaining shoulder of appreciable width within the tubular formation and at the side wall thereof when adjacent liner portions are in contact. The opposite end of the board has its inner liner extending beyond the adjacent edge of the corrugated layer forming a tubular end extension therefor.

(5) U.S. Pat. No. 2,501,815 to Hamm.

U.S. Pat. No. 2,501,815 issued to Hamm on Mar. 28, 1950 in class 16 and subclass 116 teaches a pot holder including a body member having solely a plurality of layers of flexible crepe paper adhesively secured together along their edges. The paper has resilient characteristics, whereby the holder assumes substantially a flat position when not in use and corresponds to the opening and closing movements of the hand of the user when being used.

(6) U.S. Pat. No. 2,617,549 to Egger.

U.S. Pat. No. 2,617,549 issued to Egger on Nov. 11, 1952 in class 215 and subclass 100 teaches a coaster-type holder for containers for cold drinks, which includes a cylindrical body formed of disposable absorbent paper, and is open at its top, and has a bottom and an annular wall. The lower edge of the annular wall is integrally connected with the bottom, about the peripheral edge thereof. The annular wall is fluted longitudinally for the entire distance between its upper and its lower edges, thereby providing crimps permitting expansion and contraction of the annular wall. The crimps define internal water-receiving channels extending the full depth of the wall, and through which, the water of condensation may flow downwardly along the outer surface of a container fitted into the body and be absorbed by walls of the channels. A set coating of paraffin covers the under face of the bottom and the outer surface of the lower portion only of the fluted wall, which serves to waterproof the under face of the bottom and reinforce the bottom and the junction between the bottom and the lower end of the fluted annular wall. An elastic band extends about the annular wall in downwardly spaced relation to the upper edge thereof, is adhesively fixed to outer faces of the flutes, is expansible between the flutes, serves to permit expansion of the fluted wall when a container is thrust into the body, and holds the annular wall in close fitting binding engagement with the wall of the container.

(7) U.S. Pat. No. 2,641,402 to Bruun.

U.S. Pat. No. 2,641,402 issued to Bruun on Jun. 9, 1953 in class 229 and subclass 4.5 teaches a container having a side wall formed of a surface of revolution, which includes a thin, soft-metal foil formed into a cup shape and has pleated side walls of compressed overlapping layers of foil material. The container further has a number of relief grooves impressed over the entire surface of the side walls thereof, and which is superimposed over the pleats. The relief grooves are closer together than the fold lines of the side folds, are parallel to the generatrix of the side wall, and intersect the fold lines, whereby causing the overlapping layers of the foil material to interlock. The overlapping layers of foil are held together solely by the relief grooves and without the use of adhesive.

(8) U.S. Pat. No. 2,661,889 to Phinney.

U.S. Pat. No. 2,661,889 issued to Phinney on Dec. 8, 1953 in class 229 and subclass 14 teaches an insulated container jacket including an outer frusto conical-shaped sleeve and an inner corrugated lining with a plurality of open vertically disposed separated channels therein, with both the upper and the lower ends of the channels open, and with the inner surface of the lining also frusto conical-shaped. A cup-like, frusto conical-shaped container, the upper and lowers ends of which are rolled inwardly with a closure permanently secured in the lower end. An outer ring has a bead with a groove in the inner surface around the upper end of the container, and a cap is secured in the groove of the ring.

(9) U.S. Pat. No. 2,969,901 to Behrens.

U.S. Pat. No. 2,969,901 issued to Behrens on Jan. 31, 1961 in class 229 and subclass 1.5 teaches a flat bottom paper cup including a body part formed from a rolled blank having overlapping marginal portions forming a side seam and a skirtless bottom. The lower margin of the body part is folded under the bottom and is secured thereto. The outer overlapping lower marginal portion of the body part has an extension on the bottom edge thereof, which reaches on both sides of the free edges of the inner overlapped lower marginal portion and which extends farther beneath the bottom than the bottom edge of the inner lower marginal portion. The extension is secured directly to the bottom, whereby to prevent leakage past the bottom end of the seam.

(10) U.S. Pat. No. 3,237,834 to Davis et al.

U.S. Pat. No. 3,237,834 issued to Davis et al. on Mar. 1, 1966 in class 229 and subclass 1.5 teaches an insulated food container including a side wall made of foam film, laminated-plastic material, with the inner ply of the material being formed-plastic and the outer ply being a film. The foam and film plies are bonded together over facing surfaces. The inner foam ply has an increasing density across a portion of its cross-section, with a relatively high density portion of the foam facing, and being bonded to, the film ply. Protuberances are provided in the film and in corresponding underlying areas of the foam. Air-pockets defined within the foam ply underlie, and are co-extensive with, the protuberances.

(11) U.S. Pat. No. 3,779,157 to Ross, Jr. et al.

U.S. Pat. No. 3,779,157 issued to Ross, Jr. et al on Dec. 18, 1973 in class 100 and subclass 240 teaches a receptacle for receiving, compacting, storing, segregating, and eventual disposal of the compacted trash. It includes an outer holder, an inner removable and disposable container, and an overlying combined funnel and cover. The funnel opens into the top of the disposable container. The cover is pivoted to the funnel so as to be swung outwardly therefrom and is provided with a hole through which a manually actuated compactor or ram may be inserted for crushing the trash.

(12) U.S. Pat. No. 3,785,254 to Mann.

U.S. Pat. No. 3,785,254 issued to Mann on Jan. 15, 1974 in class 93 and subclass 36.01 teaches a method for making an insulated container by spraying a cardboard surface with a resinous foam material having a wet-out time of no greater than about three seconds and a cure time of no greater than about thirty seconds. The cardboard surface may be formed into a container either before or after spraying, with the spraying forming an insulating coating on the internal surfaces of the container.

(13) U.S. Pat. No. 3,890,762 to Ernst et al.

U.S. Pat. No. 3,890,762 issued to Ernst et al on Jun. 24, 1975 in class 53 and subclass 25 teaches a preservation for agricultural produce, which is obtained by packing the product in an insulative container having a corrugated cardboard outer shell and an interior liner formed from separate flat panels of polystyrene foam of specified characteristics.

(14) U.S. Pat. No. 3,908,523 to Shikaya.

U.S. Pat. No. 3,908,523 issued to Shikaya on Sep. 30, 1975 in class 93 and subclass 36.01 teaches a method of forming a liquid-tight cup. The liquid-tight cup includes a cup-like body and a sheet member disposed around the peripheral surface of the cup-like body, with the sheet member being corrugated to provide a plurality of concavo-convex flutes, whereby air compartments are provided between the peripheral surface of the cup-like member and the inner surface of the sheet member. The method includes forming the sheet member by cutting from a planar sheet a planar blank having a width in excess of the peripheral length of the circular bottom of an inner cup member and a length substantially equal to the height of the side wall of the inner cup member. The opposite ends of the planar blank are then united in overlapped relation to form a circular cross-section sleeve constituting an outer member and after the uniting, the blank is formed with concavo-convex flutes to form a structure whose peripheral surface is corrugated. The inner and outer members are then telescoped to form a composite liquid-tight cup, with heat insulating air passages extending upwardly along the outer surface of the side wall of the inner cup member.

(15) U.S. Pat. No. 4,080,880 to Shikaya.

U.S. Pat. No. 4,080,880 issued to Shikaya on Mar. 28, 1978 in class 93 and subclass 94 teaches a method of preparing a cylindrical corrugated article, including: supplying a sheet material between a pair of rotatable forming rolls having interlocking corrugated surfaces, thereby to press and corrugate the sheet material; mounting the resulting corrugated article on the rounded surface of one of the forming rolls by way of a guide member; and then discharging the thus-mounted, cylindrical, corrugated article from the forming roll.

(16) U.S. Pat. No. 4,146,660 to Hall et al.

U.S. Pat. No. 4,146,660 issued to Hall et al. on Mar. 27, 1979 in class 428 and subclass 2 teaches insulation including a multiplicity of small chips of corrugated cardboard. The chips have varying external configurations and varying orientation of the long axis of the flute(s) with a side of the chip. The chips may be utilized as loose, bagged, or block insulation.

(17) U.S. Pat. No. 4,176,054 to Kelley.

U.S. Pat. No. 4,176,054 issued to Kelley on Nov. 27, 1979 in class 209 and subclass 8 teaches a method of waste paper recycling, wherein the unwanted portions of waste paper, such as those containing a binder adhesive, are separated from the remaining paper material. In the binding of books, catalogues, directories, pamphlets, magazines, and the like, adhesive material is provided having a magnetic substance therein, and in subsequent recycling, the waste paper from these books and magazines is cut into a plurality of relatively small pieces. These pieces are passed through a magnetic field, wherein the portions containing the adhesive having magnetic material therein are separated from the remaining non-magnetically attracted sheets of paper. The process can be carried out wet or dry, and also included is an adhesive for use in book, magazine, catalogue, and pamphlet binding processes, wherein a proportion of magnetic or paramagnetic material is integrated with the adhesive material—preferably of the hot melt type commonly used in binding books—so that upon subsequent recycling of the books, etc. as waste paper, the adhesive containing portions of the paper may be magnetically separated from the rest of the waste paper sheets.

(18) U.S. Pat. No. 5,009,326 to Reaves et al.

U.S. Pat. No. 5,009,326 issued to Reaves et al. on Apr. 23, 1991 in class 220 and subclass 441 teaches an insulated container for shipping perishable products. An insulated container system includes a telescoping container having a top and a bottom. The top and the bottom are each formed from a rectangular sheet of corrugated cardboard. The sheet is coated with wax to repel moisture. The sheet is folded inwardly to form corners. Inwardly folded sections form multilayered, triangular regions of side walls. Single-layered, central-side-wall portions between the multilayered regions are trapezoidal. A one-piece insulating liner is formed by folding a sheet of expanded polystyrene along creases. The one-piece insulating liner has trapezoidal side walls and rectangular end walls forming an integral structure with a floor. The one-piece insulating liner is inserted into the bottom, and covers single layered portions of the bottom. An insulating lid covers a ceiling of the top. An optional liner and an absorbent pad may be used to protect the one-piece insulating liner and the insulating lid from moisture.

(19) U.S. Pat. No. 5,092,485 to Lee.

U.S. Pat. No. 5,092,485 issued to Lee on Mar. 3, 1992 in class 220 and subclass 441 teaches a thermos paper cup provided with a plurality of air chambers between the inner side and the outer side and having a distance between the bottom and the lower edge so as to separate the contents from the outside, thereby keeping the contents at an unchanged temperature.

(20) U.S. Pat. No. 5,205,473 to Coffin, Sr.

U.S. Pat. No. 5,205,473 issued to Coffin, Sr. on Apr. 27, 1993 in class 229 and subclass 1.5 B teaches corrugated beverage containers and holders employing recyclable materials, and providing fluting structures for containing insulating air.

(21) U.S. Pat. No. 5,222,656 to Carlson.

U.S. Pat. No. 5,222,656 issued to Carlson on Jun. 29, 1993 in class 229 and subclass 1.5 H teaches a sleeve for insulating the hand while holding a beverage cup. A tubular body of felt-like material has first and second ends, wherein the body is conically arrayed about an axis intersecting the centers of the first and second ends and is sized to conform in a press fit relationship with the sidewall of a beverage cup when the beverage cup is inserted into the sleeve through the first end of the body.

(22) U.S. Pat. No. 5,385,260 to Gatcomb.

U.S. Pat. No. 5,385,260 issued to Gatcomb on Jan. 31, 1995 in class 220 and subclass 415 teaches a disposable paper cup for serving cold food products and beverages converted into a hot cup by the addition of an insulating sleeve assembled on the cold cup by the user. One part of a cohesive compound carried by the cold cup cooperates in registry with another part of the cohesive compound carried by the insulating sleeve to instantaneously and aggressively adhere the sleeve in assembly with the cold cup when the sleeve is mounted on the cold cup by the user.

(23) U.S. Pat. No. 5,826,786 to Dickert.

U.S. Pat. No. 5,826,786 issued to Dickert on Oct. 27, 1998 in class 229 and subclass 403 teaches a cup holder sleeve formed in pre-assembled, flat-folded form by die-cutting a flat, elongated band from blank stock material so as to have top and bottom arcuate edges concentric to, and in parallel with, each other. Fold lines are scored into the band at spaced-apart positions tapering toward each other, and into side edges at opposite ends of the band. The opposite ends are folded flat at the fold lines, so that the side edges overlap each other, and are glued together at their overlapping surfaces. The flat-folded form allows for compact storage. The pre-assembled sleeve can be readied for use simply by squeezing on the outside surfaces so as to bow out the flat-folded band into an annular tapered sleeve with opened top and bottom ends for inserting a cup therein. In a preferred embodiment, the sleeve is made of paperboard material, is printed with graphics, and is embossed with a pattern to provide an insulating layer, as well as better gripping of the sides of the cup. The die-cutting, folding, and glueing of the sleeve can be done in one production process for ease of fabrication.

(24) U.S. Pat. No. Des. 401,122 to Rench et al.

U.S. Pat. No. Des. 401,122 issued to Rench et al. on Nov. 17, 1998 in class D7 and subclass 624 teaches the ornamental design for a cup holder.

(25) U.S. Pat. No. 6,158,612 to Alpert.

U.S. Pat. No. 6,158,612 issued to Alpert on Dec. 12, 2000 in class 220 and subclass 739 teaches a holder for a container, which has a sleeve with an inner surface, an outer surface, an upper end, and a lower end. The upper end of the sleeve is configured to permit the sleeve to be positioned on an outer peripheral surface of a container, with the inner surface of the sleeve engaged with an outer peripheral surface of the container. The sleeve is constructed of an insulated, transparent, or translucent material to permit a user to comfortably and conveniently hold the outer surface of the sleeve positioned on a container, with a hot or cold beverage disposed therein, while permitting indicia printed on an exterior surface of the container to be visible there through.

(26) U.S. Pat. No. 6,152,363 to Rule, Jr.

U.S. Pat. No. 6,152,363 issued to Rule, Jr. on Nov. 28, 2000 in class 229 and subclass 403 teaches the construction of sleeves for use with paperboard cups. The structures of this type generally employ a paperboard sleeve backed with hot-melt glue dots used to improve the insulating characteristics of a paperboard cup to the same level of common polystyrene cups.

(27) U.S. Pat. No. 6,277,454 B1 to Neale et al.

U.S. Pat. No. 6,277,454 B1 issued to Neale et al on Aug. 21, 2001 in class 428 and subclass 34.2 teaches a single-walled container for storing hot or cold foods or liquids, which has a layer of insulation made of void-containing particles held together with a binder applied to the outer part of the sidewall. The insulation layer provides a controlled amount of insulation sufficient to prevent pain to the fingers, yet transmits sufficient heat to warn the user of the temperature of the container's contents. The binder may be any thermoplastic or thermoset resin, and other ingredients may be added to the binder to control viscosity, density, or color.

(28) U.S. Pat. No. D493,108 S to Burr et al.

U.S. Pat. No. D493,108 S issued to Burr et al. on Jul. 20, 2004 in class D9 and subclass 433 teaches the ornamental design for a handle.

(29) U.S. Pat. No. D524,118 S to Gregorczyk.

U.S. Pat. No. D524,118 S issued to Gregorczyk on Jul. 4, 2006 in class D7 and subclass 624.2 teaches the ornamental design for an absorbent sleeve.

(30) U.S. Pat. No. D543,844 S to Cook et al.

U.S. Pat. No. D543,844 S issued to Cook et al. on Jun. 5, 2007 in class D9 and subclass 444 teaches the ornamental design for a protective sleeve.

It is apparent that numerous innovations for containers, cups, and related devices have been provided in the prior art that are adapted to be used. Furthermore, even though these innovations may be suitable for the specific individual purposes to which they address, however, they would not be suitable for the purposes of the embodiments of the present invention as heretofore described, namely, a single-sheeted-type and dual handled-type carrier for suspending a drinking cup by one hand and method.

2. SUMMARY OF THE INVENTION

Thus, it is an object of the embodiments of the present invention to provide a single-sheeted-type and dual-handled-type carrier for suspending a drinking cup by one hand and method, which avoids the disadvantages of the prior art.

Briefly stated, another object of the embodiments of the present invention is to provide a single-sheeted-type and dual-handled-type carrier for suspending a drinking cup by one hand. The carrier includes a single sheet blank. The single sheet blank is rectangular-shaped, planar, and cut and folded into a specific configuration having dual handles for suspending the drinking cup from the one hand.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying drawings.

3. BRIEF DESCRIPTION OF THE DRAWINGS

The figures of the drawings are briefly described as follows.

4. REFERENCE NUMERALS UTILIZED IN THE DRAWINGS

A. General

Figure 1:
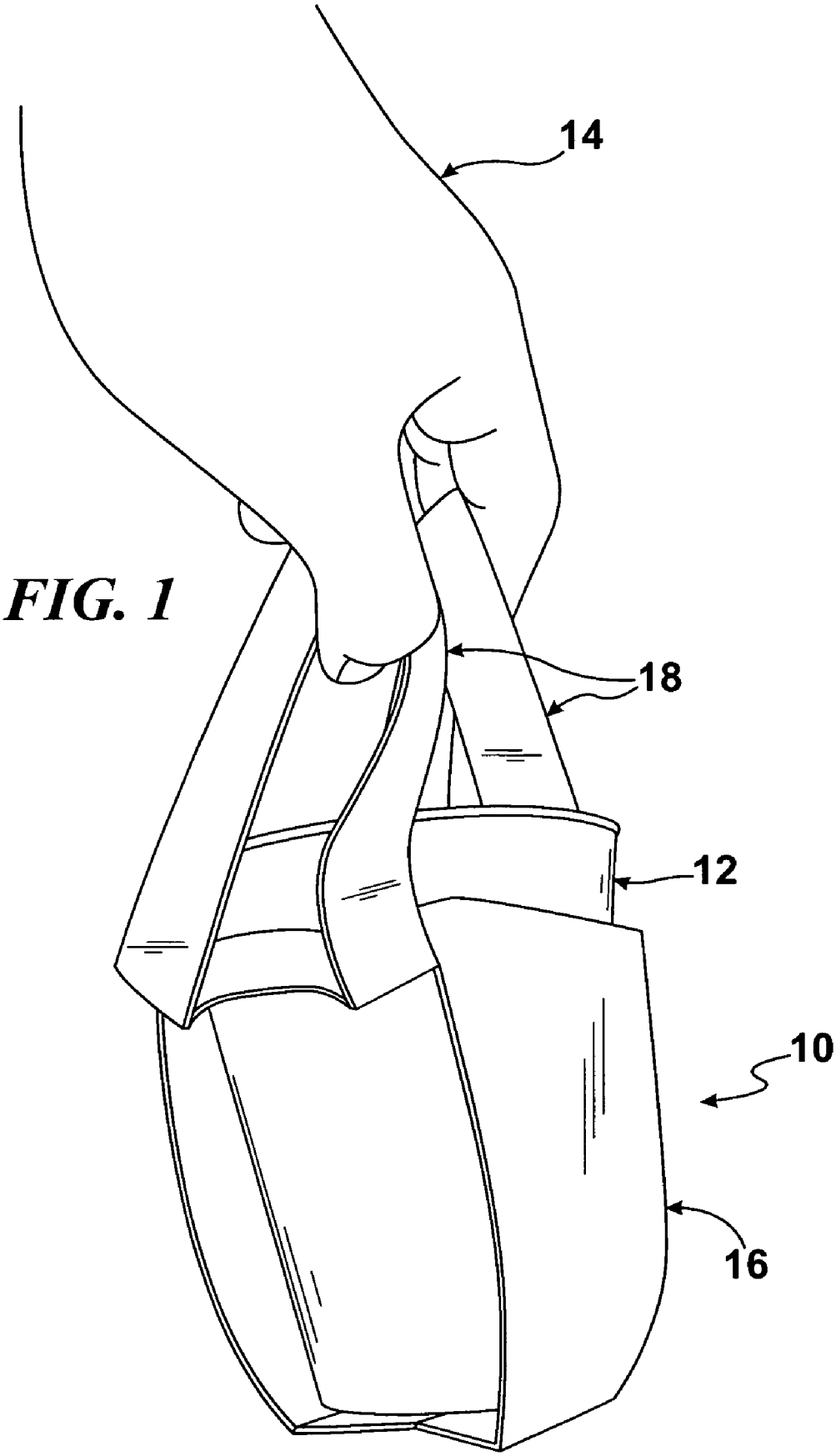
FIG. 1 is a diagrammatic perspective view of the single-sheeted-type and dual-handled-type carrier of the embodiments of the present invention suspending a drinking cup by one hand.

10 single-sheeted-type and dual-handled-type carrier of embodiments of present invention for suspending drinking cup 12 by one hand 14

12 drinking cup

14 one hand

B. Configuration of Single-Sheeted-Type and Dual-Handled-Type Carrier 10 Prior to Folding

16 single sheet blank

18 dual handles of single sheet blank 16 for suspending drinking cup 12 from one hand 14

20 pair of long sides of sheet blank 16

22 pair of short sides 22 of sheet blank 16

24 pair of waste portions cut-out of sheet blank 16

25 apexes of pair of waste portions 24 cut-out of sheet blank 16

26 sides of pair of waste portions 24 cut-out of sheet blank 16

28 bases of pair of waste portions 24 cut-out of sheet blank 16

30 tabs of sheet blank 16

32 corners of sheet blank 16

34 through slits in sheet blank 16

35 terminators of through slits 34 in sheet blank 16

36 main fold line of sheet blank 16

38 pair of secondary fold lines of sheet blank 16

39 bottom

40 through bores in sheet blank 16

C. Method of Folding Single-Sheeted-Type and Dual-Handled-Type Carrier 10

42 cup-receiving cradle

44 edges of cup-receiving cradle 42

5. DETAILED DESCRIPTION OF THE PREFERRED EMBODIMENTS

A. General

Referring now to the drawings, in which similar references numerals indicate similar parts, and particularly to FIG. 1, which is a diagrammatic perspective view of the single-sheeted-type and dual-handled-type carrier of the embodiments of the present invention suspending a drinking cup by one hand, the single-sheeted-type and dual-handled-type carrier of the embodiments of the present invention is shown generally 10 for suspending a drinking cup 12 by one hand 14.

B. The Configuration of the Single-Sheeted-Type and Dual-Handled-Type Carrier 10 Prior to Folding The single-sheeted-type and dual-handled-type carrier 10 comprises a single sheet blank 16. The single sheet blank 16 is rectangular-shaped, planar, and is cut and folded into a specific configuration having dual handles 18 for suspending the drinking cup 12 from the one hand 14.

Figure 2:
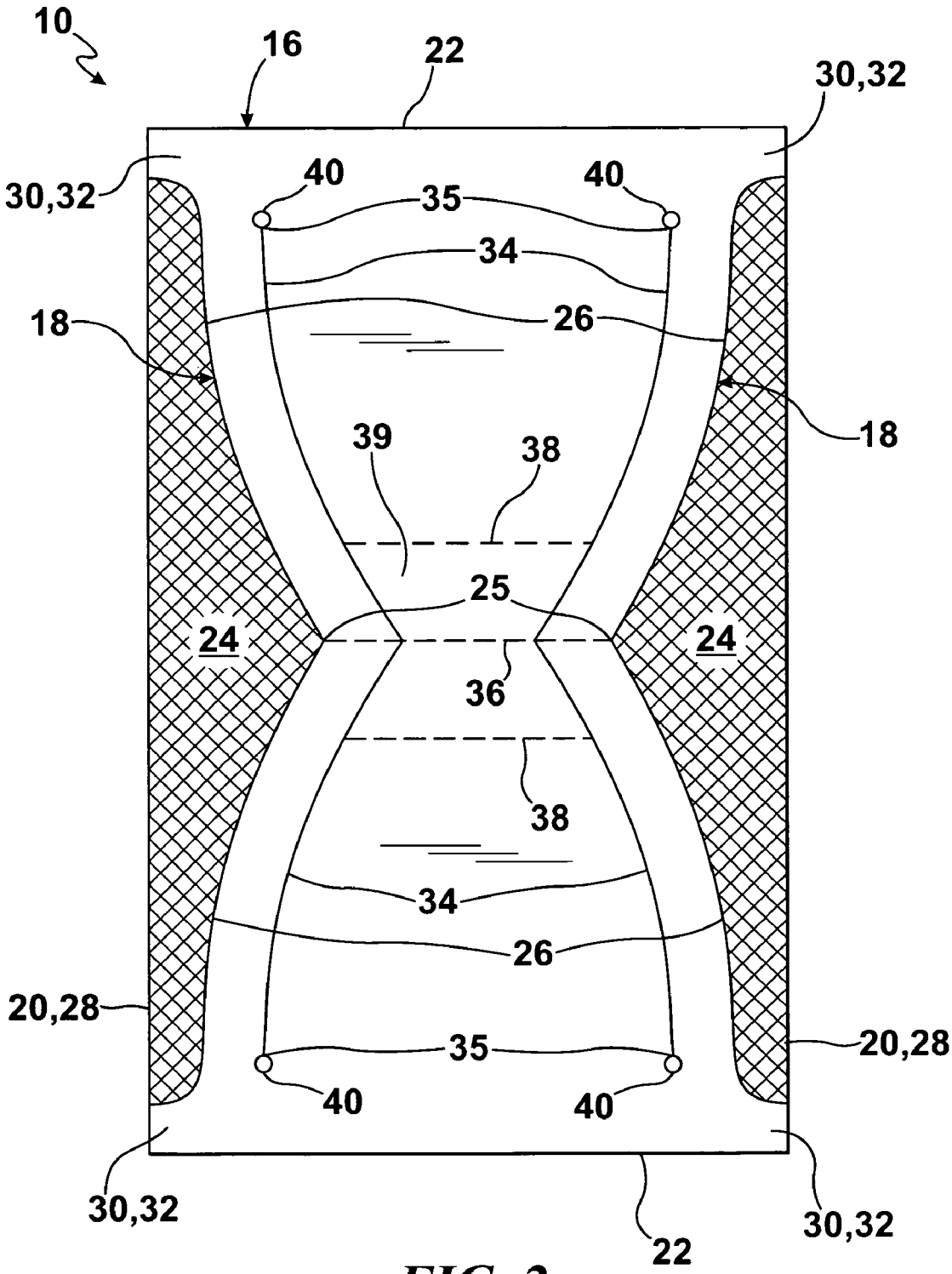
FIG. 2 is a diagrammatic plan view identified by ARROW 2 in FIG. 1 of the single-sheeted-type and dual-handled-type carrier of the embodiments of the present invention prior to folding.

The configuration of the sheet blank 16 can best be seen in FIG. 2, which is a diagrammatic plan view identified by ARROW 2 in FIG. 1 of the single-sheeted-type and dual-handled-type carrier of the embodiments of the present invention prior to folding, and as such, will be discussed with reference thereto.

Being that the sheet blank 16 is rectangular-shaped, the sheet blank 16 has a pair of long sides 20 and a pair of short sides 22.

The sheet blank 16 further has a pair of waste portions 24. The pair of waste portions 24 are cut-out of the sheet blank 16, and are substantially isosceles triangular-shaped having apexes 25, sides 26 being concave, and bases 28 coinciding with the pair of long sides 20 of the sheet blank 16 and extending just short of the pair of short sides 22 of the sheet blank 16 so as to leave tabs 30 at corners 32, i.e., where the pair of long sides 20 of the sheet blank 16 meet the pair of short sides 22 of the sheet blank 16, respectively The sheet blank 16 further has through slits 34. The through slits 34 in the sheet blank 16 extend substantially parallel to, inwardly of, substantially as long as, form the dual handles 18 with, the sides 26 of the pair of waste portions 24, to terminators 35.

The sheet blank 16 further has a main fold line 36. The main fold line 36 of the sheet blank 16 extends from the apex 25 of one waste portion 24 of the sheet blank 16 to the apex 25 of the other waste portion 24, and is substantially equidistant from the pair of short sides 22 of the sheet blank 16.

The sheet blank 16 further has a pair of secondary fold lines 38. The pair of secondary fold lines 38 of the sheet blank 16 are parallel to, and equidistantly straddle, the main fold line 36 of the sheet blank 16, extend from the sides 34 of one waste portion 24 of the sheet blank 16 to the sides 26 of the other waste portion 24 of the sheet blank 16, respectively, and define a bottom 39.

The sheet blank 16 further has through bores 40. The through bores 40 in the sheet blank 16 are disposed at, and communicate with, the terminators 35 of the through slits 34 in the sheet blank 16, and facilitate final positioning of the dual handles 18.

Figure 5:
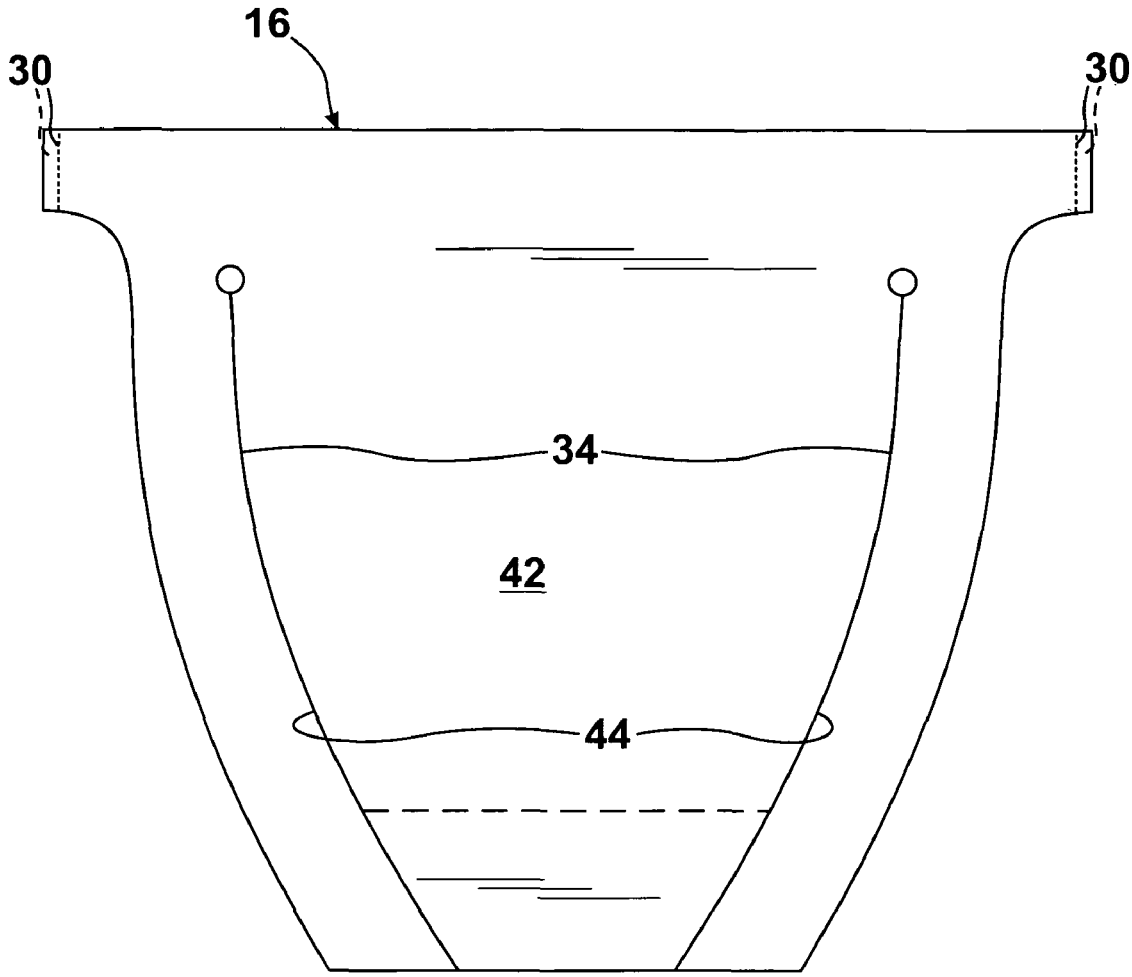
FIG. 5 is a diagrammatic side elevational view of the single-sheeted-type and dual-handled-type carrier of the embodiments of the present invention further being folded.

As shown in FIG. 5, which is a diagrammatic side elevational view of the single-sheeted-type and dual-handled-type carrier of the embodiments of the present invention further being folded, optionally, edges 44 of adjacent portions of a cup-receiving cradle 42 are attached to each other so as to allow the cup-receiving cradle 42 to be closed therearound.

C. The Method of Folding the Single-Sheeted-Type and Dual-Handled-Type Carrier 10

The method of folding the single-sheeted-type and dual-handled-type carrier 10 can best be seen in FIGS. 3-6, which are, respectively, a diagrammatic plan view of the single-sheeted-type and dual-handled-type carrier of the embodiments of the present invention without the pair of waste portions, a diagrammatic perspective view of the single-sheeted-type and dual-handled-type carrier of the embodiments of the present invention beginning to be folded, a diagrammatic side elevational view of the single-sheeted-type and dual-handled-type carrier of the embodiments of the present invention further being folded, and a diagrammatic perspective view of the single-sheeted-type and dual-handled-type carrier of the embodiments of the present invention folded and ready for use, and as such, will be discussed with reference thereto.

Figure 3:
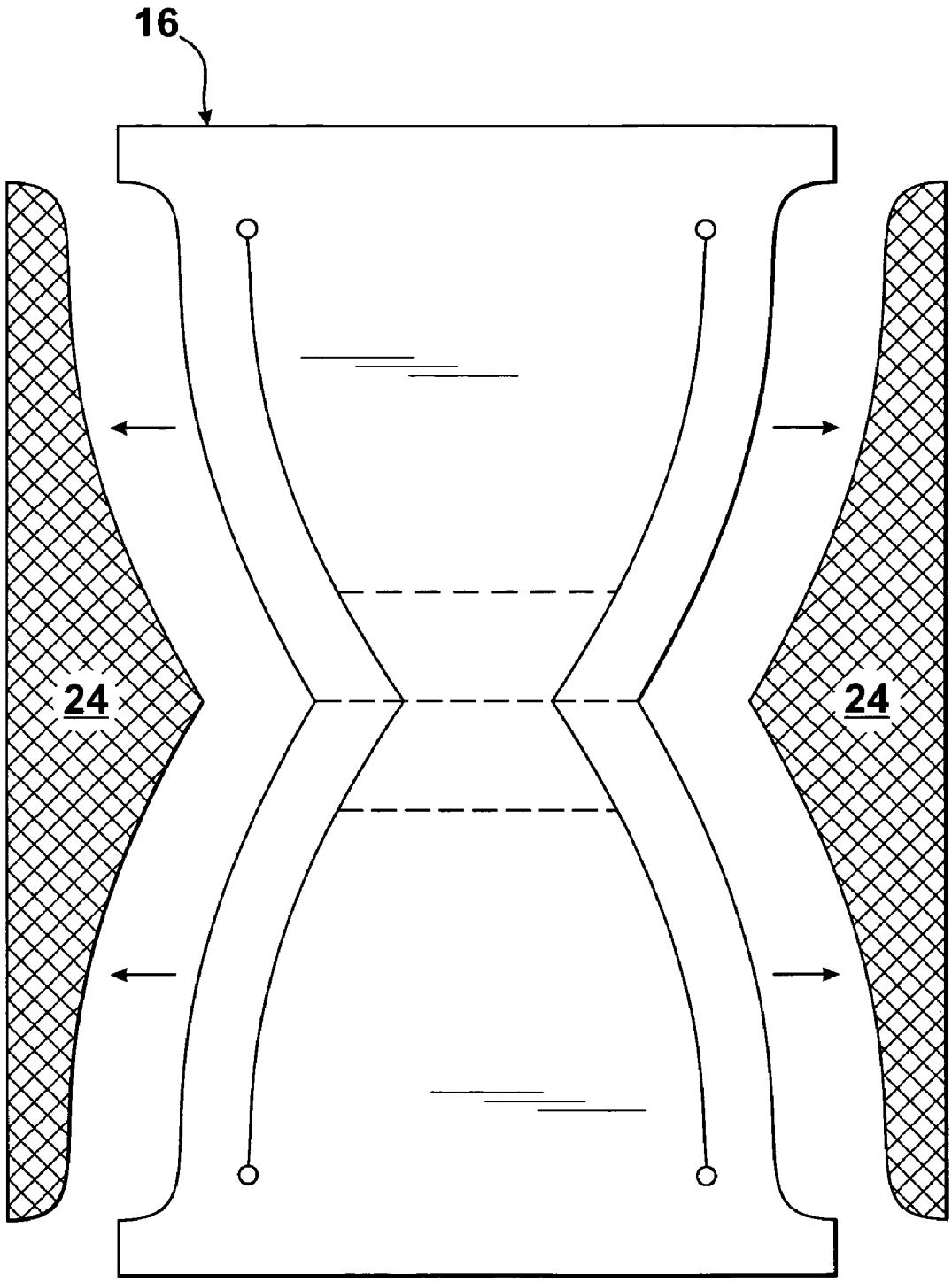
FIG. 3 is a diagrammatic plan view of the single-sheeted-type and dual-handled-type carrier of the embodiments of the present invention without the pair of waste portions.

STEP 1: As shown in FIG. 3, remove the pair of waste portions 24 from the sheet blank 16.

Figure 4:
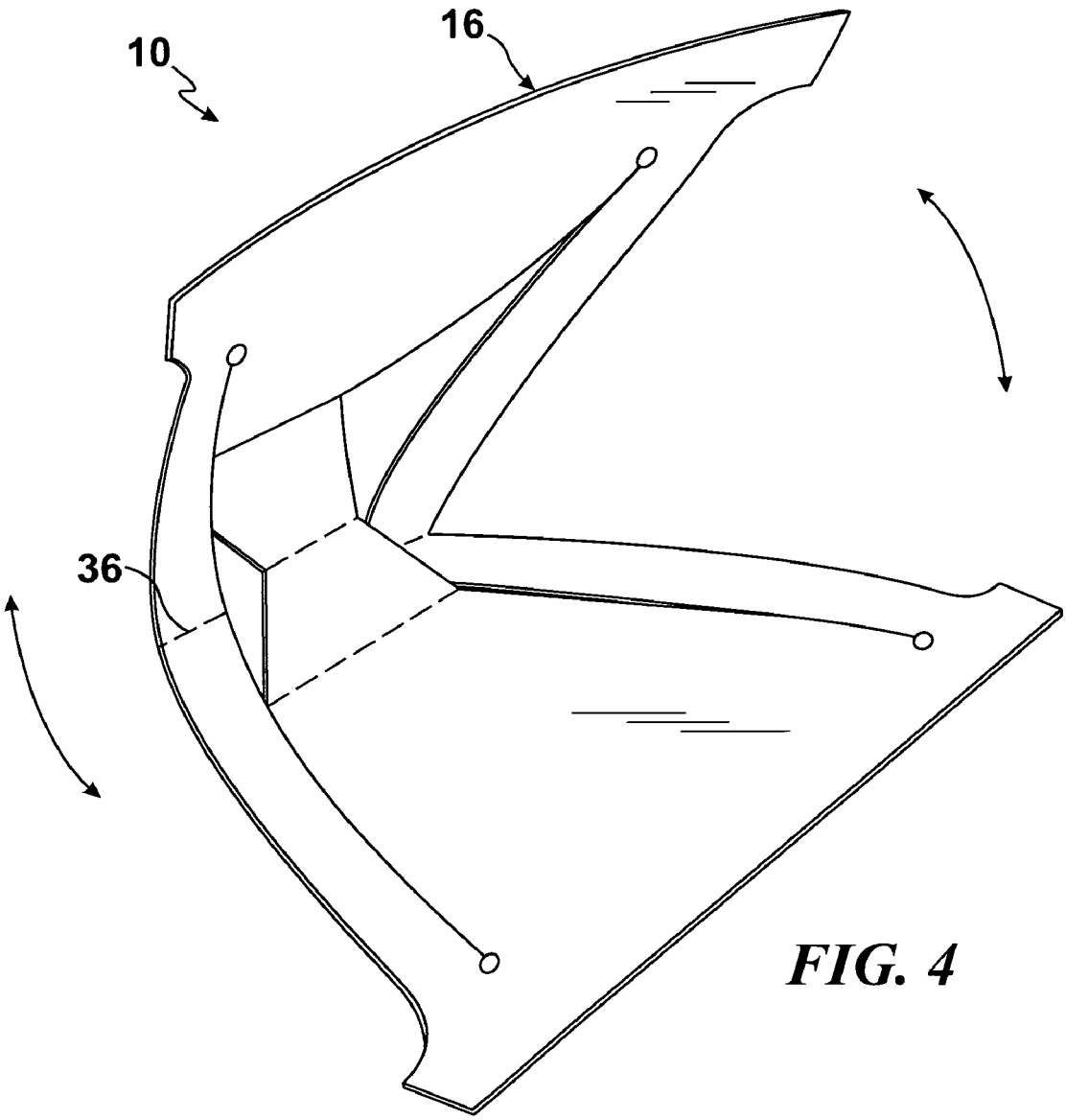
FIG. 4 is a diagrammatic perspective view of the single-sheeted-type and dual-handled-type carrier of the embodiments of the present invention beginning to be folded.

STEP 2: As shown in FIG. 4, fold the sheet blank 16 along the main fold line 36 thereof.

STEP 3: As shown in FIG. 5, continue to fold the sheet blank 16 onto itself.

STEP 4: As shown in FIG. 5, affix adjacent tabs 30 to each other to form a cup-receiving cradle 42 having edges 44 at the through slits 34 in the sheet blank 16

STEP 5: Optionally, attach the edges 44 of adjacent portions of the cup-receiving cradle 42 to each other so as to allow the cup-receiving cradle 42 to be closed therearound.

Figure 6:
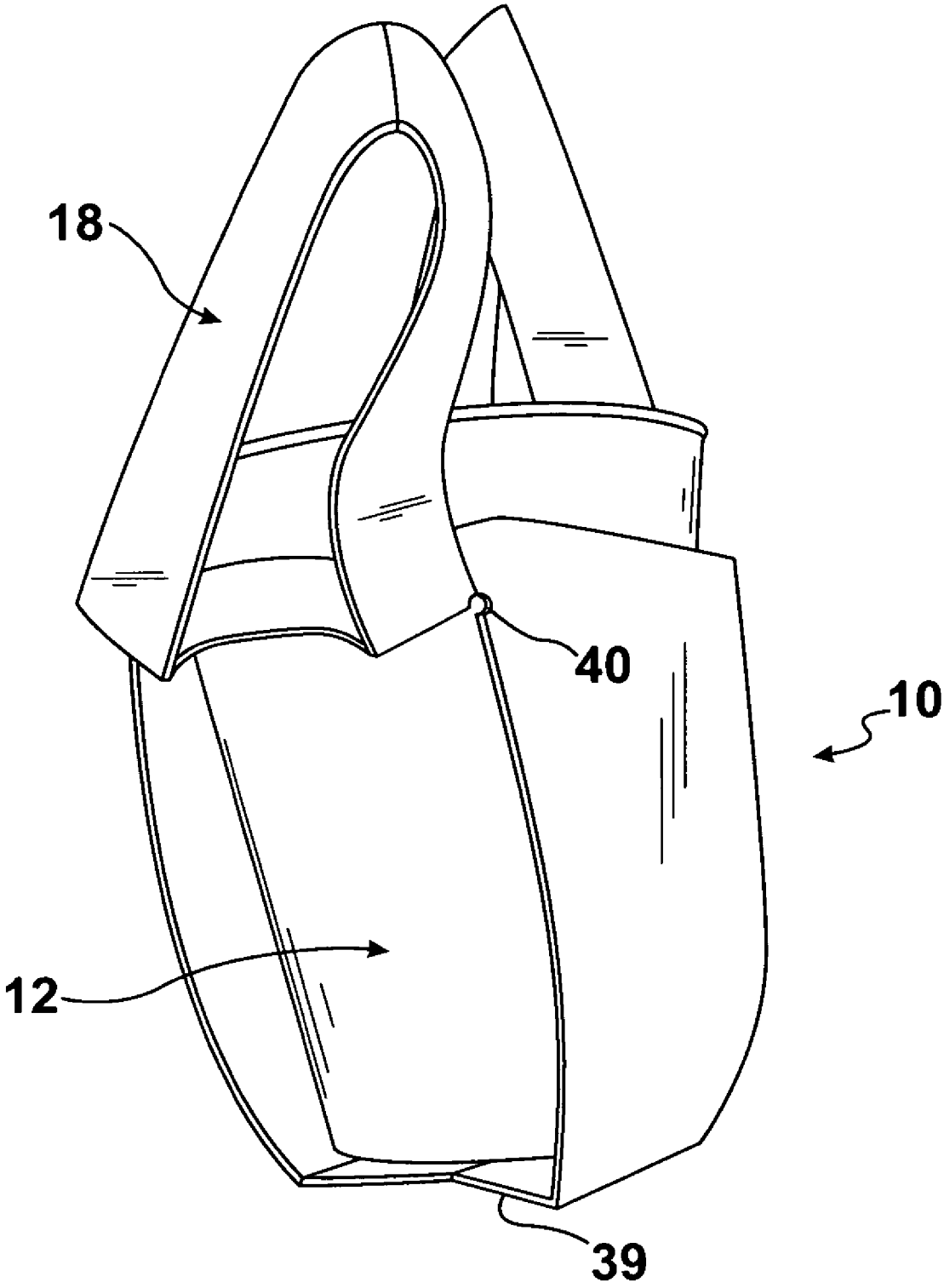
FIG. 6 is a diagrammatic perspective view of the single-sheeted-type and dual-handled-type carrier of the embodiments of the present invention folded and ready for use.

STEP 6: As shown in FIG. 6, pivot the dual handles 18 upwardly at the through bores 40.

STEP 7: As shown in FIG. 6, flatten out the bottom 39 of the cup-receiving cradle 42.

STEP 8: Insert the drinking cup 12 snugly into the cup-receiving cradle 42 and carry the drinking cup 12, which is now suspended by the dual handles 18, by the dual handles 18.

D. The Conclusions

It will be understood that each of the elements described above or two or more together may also find a useful application in other types of constructions differing from the types described above.

While the embodiments of the present invention have been illustrated and described as embodied in a single-sheeted-type and dual-handled-type carrier for suspending a drinking cup by one hand and method, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features from the standpoint of prior art fairly constitute characteristics of the generic or specific aspects of the embodiments of the present invention.

The invention claimed is:

1. A carrier having a periphery for suspending a drinking cup by one hand, comprising:

a single sheet blank;

wherein said single sheet blank is rectangular-shaped;

wherein said single sheet blank is planar;

wherein said single sheet blank is cut and folded into a specific configuration having dual handles for suspending the drinking cup from the one hand; and wherein said dual handles are spaced apart from each other and extend upwardly from opposing portions of said periphery of said carrier when in use;

wherein said sheet blank has a main fold line;

wherein said sheet blank has a pair of secondary fold lines;

wherein said pair of secondary fold lines of said sheet blank are parallel to said main fold line of said sheet blank;

wherein said pair of secondary fold lines of said sheet blank equidistantly straddle said main fold line of said sheet blank;

wherein said carrier has a bottom periphery; and wherein said pair of secondary fold lines are said bottom periphery of said carrier when folded.

2. The carrier of claim 1, wherein said sheet blank has a pair of waste portions; and wherein said pair of waste portions are cut-out of said sheet blank.

3. The carrier of claim 2, wherein said sheet blank have a pair of long sides;

wherein said sheet blank have a pair of short sides;

wherein said pair of waste portions of said sheet blank are substantially isosceles triangular-shaped;

wherein said pair of waste portions of said sheet blank have sides;

wherein said pair of waste portions of said sheet blank have bases;

wherein said bases of said pair of waste portions of said sheet blank coincide with said pair of long sides of said sheet blank; and wherein said bases of said pair of waste portions of said sheet blank extend just short of said pair of short sides of said sheet blank so as to leave tabs at corners where said pair of long sides of said sheet blank meet said pair of short sides of said sheet blank.

4. The carrier of claim 3, wherein said sides of said pair of waste portions of said sheet blank are concave.

5. The carrier of claim 3, wherein said sheet blank has through slits;

wherein said through slits in said sheet blank extend substantially parallel to said sides of said pair of waste portions;

wherein said through slits in said sheet blank extend inwardly of said sides of said pair of waste portions;

wherein said through slits in said sheet blank are substantially as long as said sides of said pair of waste portions and terminate in terminators; and wherein said through slits in said sheet blank form said dual handles with said sides of said pair of waste portions.

6. The carrier of claim 3, wherein said pair of waste portions of said sheet blank have apexes;

wherein said main fold line of said sheet blank extends from said apex of one waste portion of said sheet blank to said apex of the other waste portion; and wherein said main fold line of said sheet blank is substantially equidistant from said pair of short sides of said sheet blank.

7. The carrier of claim 6, wherein said pair of secondary fold lines of said sheet blank extend from said sides of one waste portion of said sheet blank to said sides of the other waste portion of said sheet blank, respectively.

8. The carrier of claim 5, wherein said sheet blank has through bores;

wherein said through bores in said sheet blank are disposed at said terminators of said through slits in said sheet blank; and wherein said through bores in said sheet blank communicate with said terminators of said through slits in said sheet blank.

9. The carrier of claim 5, wherein adjacent tabs of the sheet blank are affixed to each other to form a cup-receiving cradle of said sheet blank having edges defined by said through slits in said sheet blank; and wherein edges of adjacent portions of said cup-receiving cradle are attached to each other so as to allow the cup-receiving cradle to be closed therearound.

* * * * *